US008902142B2

(12) United States Patent
Yoon et al.

(10) Patent No.: US 8,902,142 B2
(45) Date of Patent: Dec. 2, 2014

(54) LIQUID CRYSTAL DISPLAY AND METHOD OF DRIVING THE SAME

(75) Inventors: Ju-Young Yoon, Seoul (KR); Eun-Jeong Kang, Cheonan-si (KR); Seok-Won Kang, Kwangju-si (KR); Hee-Kwang Song, Ahnyang-si (KR); Ho-Sik Shin, Ahnyang-si (KR)

(73) Assignee: Samsung Display Co., Ltd. (KR)

( * ) Notice: Subject to any disclaimer, the term of this patent is extended or adjusted under 35 U.S.C. 154(b) by 1391 days.

(21) Appl. No.: 12/421,312

(22) Filed: Apr. 9, 2009

(65) Prior Publication Data

US 2009/0262057 A1 Oct. 22, 2009

(30) Foreign Application Priority Data

Apr. 17, 2008 (KR) ..... 10-2008-0035658

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 3/342* (2013.01); *G09G 2320/0276* (2013.01); *G09G 2320/064* (2013.01); *G09G 2320/0646* (2013.01); *G09G 2330/021* (2013.01); *G09G 2360/16* (2013.01)
USPC ..... 345/89

(58) Field of Classification Search
USPC ..... 345/89, 690–693
See application file for complete search history.

(56) References Cited

U.S. PATENT DOCUMENTS

| | | | | |
|---|---|---|---|---|
| 2002/0011979 | A1* | 1/2002 | Nitta et al. | 345/89 |
| 2006/0208983 | A1* | 9/2006 | Lee et al. | 345/89 |
| 2007/0285379 | A1* | 12/2007 | Jung et al. | 345/102 |
| 2008/0074372 | A1* | 3/2008 | Baba et al. | 345/89 |
| 2009/0015601 | A1* | 1/2009 | Kim | 345/690 |

* cited by examiner

*Primary Examiner* — Dennis Joseph
(74) *Attorney, Agent, or Firm* — Cantor Colburn LLP

(57) ABSTRACT

A liquid crystal display includes: a signal controller which converts a first image signal having a first gray level based on an original gamma coefficient into a second image signal having a second gray level based on a target gamma coefficient; a liquid crystal panel connected to the signal controller and which displays an image based on the second image signal; and a light-emitting unit connected to the signal controller and which provides light to the liquid crystal panel. The target gamma coefficient is less than or equal to the original gamma coefficient, and a luminance of the light provided by the light-emitting unit is adjusted by the signal controller to minimize an amount of luminance distortion of the image.

18 Claims, 13 Drawing Sheets

LIQUID CRYSTAL DISPLAY AND METHOD OF DRIVING THE SAME

This application claims priority to Korean Patent Application No. 10-2008-0035658, filed on Apr. 17, 2008, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD") and a method of driving the LCD, and more particularly, to an LCD having enhanced display quality and reduced power consumption, and a method of driving the LCD.

2. Description of the Related Art

A liquid crystal display ("LCD") generally includes a first display substrate having a plurality of pixel electrodes, a second display substrate having a plurality of common electrodes and a liquid crystal panel having a dielectrically anisotropic liquid crystal layer interposed between the first display substrate and the second display substrate. The LCD displays an image by forming an electric field between the pixel electrodes and the common electrodes, adjusting an intensity of the electric field, and thus controlling an amount of light which transmits through the liquid crystal panel based on an alignment of liquid crystal molecules in the liquid crystal layer due to the electric field. The LCD is not a self light-emitting display, and the LCD therefore includes a light-emitting unit which provides light to the liquid crystal panel.

It is desired to develop an LCD having an enhanced display quality.

BRIEF SUMMARY OF THE INVENTION

Exemplary embodiments of the present invention provide a liquid crystal display ("LCD") having enhanced display quality and reduced power consumption. More specifically, the LCD controls a luminance of light provided by a light-emitting unit based on an image displayed on a liquid crystal panel of the LCD.

Exemplary embodiments of the present invention also provide a method of driving an LCD having enhanced display quality and reduced power consumption.

According to an exemplary embodiment of the present invention, an LCD includes: a signal controller which converts a first image signal having a first gray level based on an original gamma coefficient into a second image signal having a second gray level based on a target gamma coefficient; a liquid crystal panel connected to the signal controller and which displays an image based on the second image signal; and a light-emitting unit connected to the signal controller and which provides light to the liquid crystal panel. The target gamma coefficient is less than or equal to the original gamma coefficient, and a luminance of the light provided by the light-emitting unit is adjusted by the signal controller to minimize an amount of luminance distortion of the image.

According to an alternative exemplary embodiment of the present invention, a method of driving an LCD is provided. The LCD includes a liquid crystal panel which displays an image, and a light-emitting unit which provides light to the liquid crystal panel. The method includes: converting a first image signal having a first gray level based on an original gamma coefficient into a second image signal having a second gray level based on a target gamma coefficient; providing the second image signal to the liquid crystal panel; and adjusting a luminance of the light provided by the light-emitting unit to minimize an amount of luminance distortion of the image. The target gamma coefficient less than or equal to the original gamma coefficient.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
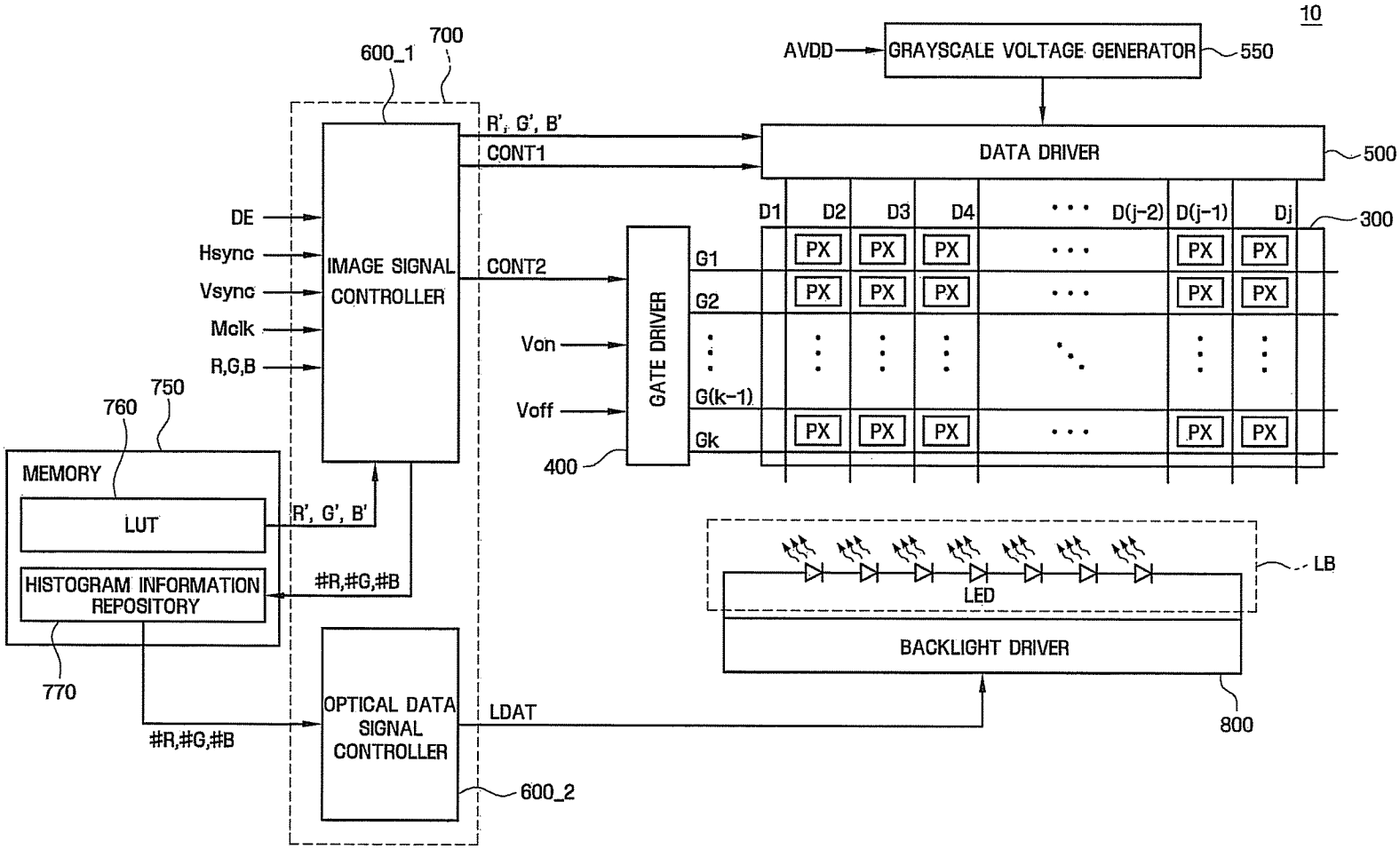
FIG. 1 is a block diagram of a liquid crystal display ("LCD") according to an exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Figure 2:
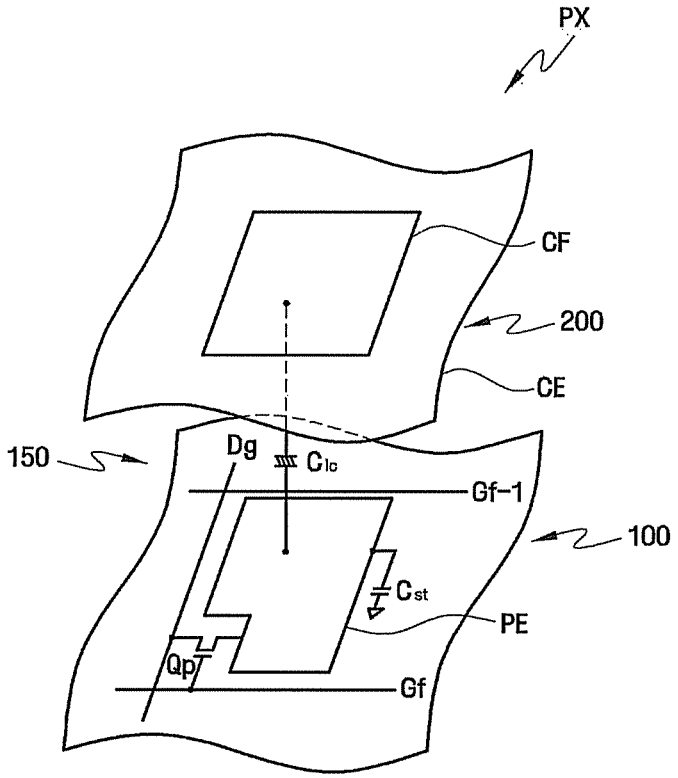
FIG. 2 is an equivalent circuit diagram of a pixel of a liquid crystal panel of the LCD according to the exemplary embodiment of the present invention shown in FIG. 1.

A liquid crystal display ("LCD") and a method of driving the same according to an exemplary embodiment of the present invention will now be described in further detail with reference to FIGS. 1 and 2. FIG. 1 is a block diagram of an LCD 10 according to an exemplary embodiment of the present invention. FIG. 2 is an equivalent circuit diagram of a pixel PX included in a liquid crystal panel 300 of the LCD 10 according to the exemplary embodiment of the present invention shown in FIG. 1.

Referring to FIG. 1, the LCD 10 includes the liquid crystal panel 300, a signal controller 700, a grayscale voltage generator 550, a gate driver 400, a data driver 500, a memory 750, a backlight driver 800 and a light-emitting unit LB connected to the backlight driver 800.

The liquid crystal panel 300 includes a plurality of gate lines G1 through Gk, a plurality of data lines D1 through Dj and a plurality of the pixels PX. In an exemplary embodiment of the present invention, the pixels PX include red, green and blue subpixels. In addition, each of the pixels PX in an LCD according to an exemplary embodiment is disposed in a region where a gate line G of the plurality of gate lines G1 through Gk and a data line D of the plurality of data lines D1 through Dj cross each other. In operation, the liquid crystal panel 300 displays an image based on second image signals R', G' and B' which will be described if further detail below.

Referring now to FIG. 2, the pixel PX is connected to, for example, an $f^{th}$ (where f=1 to k) gate line Gf and a $g^{th}$ (where g=1 to j) data line Dg and includes a switching device Qp connected to the $f^{th}$ gate line Gf and the $g^{th}$ data line Dg, as well as a liquid crystal capacitor Clc and a storage capacitor Cst which are connected to the switching device Qp. As shown in FIG. 2, the liquid crystal capacitor Clc includes two electrodes, and, more particularly, a pixel electrode PE of a first display substrate 100 and a common electrode CE of a second display substrate 200, for example. Liquid crystal molecules 150 are interposed between the pixel electrode PE and the common electrode CE. A color filter CF is formed on a portion of the common electrode CE.

Referring again to FIG. 1, the signal controller 700 receives first image signals R, G and B and external control signals for controlling display of the first image signals R, G and B. Based on the first image signals R, G and B and the external control signals, the signal controller 700 outputs the second image signals R', G' and B', a data control signal CONT1, a gate control signal CONT2 and an optical data signal LDAT. In an exemplary embodiment of the present invention, the first image signals have a first gray level which is based on an original gamma coefficient, as well be described in greater detail below.

More specifically, the signal controller 700 according to an exemplary embodiment of the present invention converts the first image signals R, G and B having the first gray level based on the original gamma coefficient into the second image signals R', G' and B'. As a result, the second image signals R', G' and B' have a second gray level based on a target gamma coefficient, as will be described in greater detail below. In an exemplary embodiment, the target gamma coefficient is less than or equal to the original gamma coefficient. Thus, the image signal controller outputs the second image signals R', G' and B' to the data driver 500, as will be described in further detail below.

The signal controller 700 also provides the optical data signal LDAT to the backlight driver 800. In an exemplary embodiment, the optical data signal LDAT has a duty ratio which minimizes an amount of image distortion, e.g., luminance distortion, of an image displayed on the liquid crystal panel 300.

In an exemplary embodiment of the present invention, the signal controller 700 may include an image signal controller 600_1 and an optical data signal controller 600_2. Further, the image signal controller 600_1 may control the image displayed on the liquid crystal panel 300, while the optical signal controller 600_2 may control the backlight driver 800. In addition, the image signal controller 600_1 and the optical data signal controller 600_2 according to an exemplary embodiment of the present invention may be physically separated from each other, but alternative exemplary embodiments are not limited to the functional or physical descriptions described herein.

In operation, the image signal controller 600_1 receives the first image signals R, G and B and outputs the second image signals R', G' and B'. Specifically, the image signal controller 600_1 reads the second gray level, which corresponds to the first gray level based on the original gamma coefficient and the target gamma coefficient, respectively, from a lookup table ("LUT") 760 (described in further detail below) and converts the first image signals R, G and B into the second image signals R', G' and B', respectively. Additionally, the image signal controller 600_1 provides the second image signals R', G' and B' to the data driver 500, as shown in FIG. 1.

In addition, the image signal controller 600_1 according to an exemplary embodiment may receive the external control signals from an external source (not shown) and generate the data control signal CONT1 and the gate control signal CONT2. In an exemplary embodiment of the present invention, the external control signals include a vertical synchronization signal Vsync, a horizontal synchronization signal Hsync, a main clock signal Mclk and a data enable signal DE, but alternative exemplary embodiments are not limited thereto. The data control signal CONT1 is used to control an operation of the data driver 500, and the gate control signal CONT2 is used to control an operation of the gate driver 400.

The image signal controller 600_1 receives the first image signals R, G and B, extracts numbers of pixels #R, #G and #B at each gray level, and provides the numbers of pixels #R, #G and #B to a histogram information repository 770. In an exemplary embodiment of the present invention, the numbers of pixels #R, #G and #B correspond to numbers of the red, green and blue subpixels, respectively, at each gray level of all available gray levels in the image which is displayed on the liquid crystal panel 300 in a given frame. An operation and structure of the image signal controller 600_1 will be described in further detail below with reference to FIGS. 3 and 4.

The optical data signal controller 600_2 according to an exemplary embodiment receives information regarding the numbers #R, #G and #B of pixels at each gray level from the histogram information repository 770, calculates an amount of luminance distortion of an image displayed on the liquid crystal panel 300, and provides the optical data signal LDAT having the duty ratio which minimizes the amount of luminance distortion to the backlight driver 800. In an exemplary embodiment, the amount of luminance distortion is an amount of distortion of real luminance of the image displayed on the liquid crystal panel 300 from an ideal luminance corresponding to the original gamma coefficient. The amount of luminance distortion, and an operation and structure of the optical data signal controller 600_2 will be described in greater detail below with reference to FIG. 5.

The grayscale voltage generator 550 provides a voltage which corresponds to the second image signals R', G' and B' to the data driver 500. Specifically, the grayscale voltage generator 550 divides a driving voltage AVDD based on the second gray level of the second image signals R', G' and B' and provides the voltages from dividing the driving voltage AVDD to the data driver 500. When the second gray level of the second image signals R', G' and B' is a highest gray level, the grayscale voltage generator 550 may provide the high-level driving voltage AVDD to the data driver 500. Conversely, when the second gray level of the second image signals R', G' and B' is a lowest gray level, the grayscale voltage generator 550 may provide a low-level ground voltage, e.g., 0 V, to the data driver 500.

In an exemplary embodiment of the present invention, the grayscale voltage generator 550 may include resistors (not shown) connected in series between a node to which the driving voltage AVDD is applied and a ground source to divide the driving voltage AVDD, but alternative exemplary embodiments of the grayscale voltage generator 550 are not limited to the abovementioned description.

The gate driver 400 receives the gate control signal CONT2 from the image signal controller 600_1 and transmits a gate signal to the gate lines G1 through Gk. The gate signal according to an exemplary embodiment includes a gate-on voltage Von and a gate-off voltage Voff provided by a gate on/off voltage generator (not shown). The gate control signal CONT2 controls an operation of the gate driver 400 and may include, for example, a vertical start signal STV (FIG. 3) for starting the operation of the gate driver 400, a gate clock signal CPV (FIG. 3) for determining when to output the gate-on voltage Von, and an output enable signal OE (FIG. 3) for determining a pulse width of the gate-on voltage Von.

The data driver 500 receives the data control signal CONT1 from the image signal controller 600_1 and applies a voltage which corresponds to the second image signals R', G' and B' to the plurality of data lines D1 through Dj. In an exemplary embodiment, the voltage which corresponds to the second image signals R', G' and B' is provided by the grayscale voltage generator 550. Specifically, the voltage which corresponds to the second image signals R', G' and B' may be the driving voltage AVDD which has been divided, as described in greater detail above, based on the second gray level of the second image signals R', G' and B'. The data control signal CONT1 includes signals used to control an operation of the data driver 500. In an exemplary embodiment, the signals used to control the operation of the data driver 500 include a horizontal start signal STH (FIG. 3) for starting the operation of the data driver 500 and an output instruction signal TP (FIG. 3) for controlling an output of an image data voltage.

The memory 750 according to an exemplary embodiment of the present invention includes the LUT 760 and the histogram information repository 770. The LUT 760 stores the second gray level of the second image signals R', G' and B' (which corresponds to the first gray level of the first image signals R, G and B). The histogram information repository 770 receives information regarding the numbers of pixels #R, #G and #B at each gray level of the image displayed on the liquid crystal panel 300 from the image signal controller 600_1 and stores the information.

The memory 750 also stores an ideal luminance at each gray level in the LUT 760. The ideal luminance at each gray level is used to calculate the amount of luminance distortion, as will be described in further detail below. When the ideal luminance at each gray level is stored in the LUT 760, the amount of luminance distortion can be calculated quickly and efficiently in the LCD 10 according to an exemplary embodiment of the present invention.

The backlight driver 800 controls a luminance of light which is provided by the light-emitting unit LB based on the optical data signal LDAT. Specifically, the luminance of the light-emitting unit LB is varied according to the duty ratio of the optical data signal LDAT. In addition, the duty ratio of the optical data signal LDAT is adjusted to minimize the amount of luminance distortion of an image displayed on the liquid crystal panel 300. A structure and operation of the backlight driver 800 will be described in further detail below with reference to FIG. 6.

The light-emitting unit LB includes one or more light sources which supply light to the liquid crystal panel 300. For example, as shown in FIG. 1, the light-emitting unit LB includes a single point light source such as a light-emitting diode ("LED"). Alternatively, the light-emitting unit LB may include a line light source or a surface light source, as will be described in further detail below with reference to FIGS. 12 and 13. The luminance of the light-emitting unit LB is controlled by the backlight driver 800, which is connected to the light-emitting unit LB.

Figure 3:
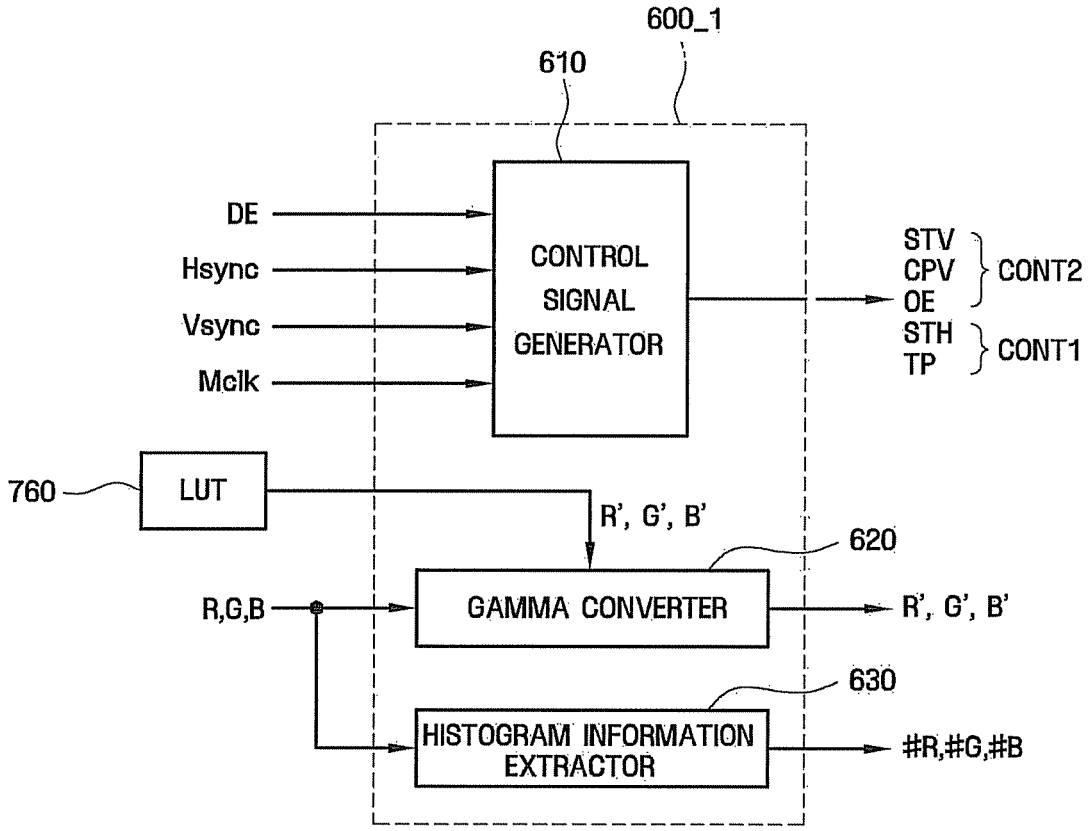
FIG. 3 is a block diagram of an image signal controller of the LCD according to the exemplary embodiment of the present invention shown in FIG. 1.
Figure 4:
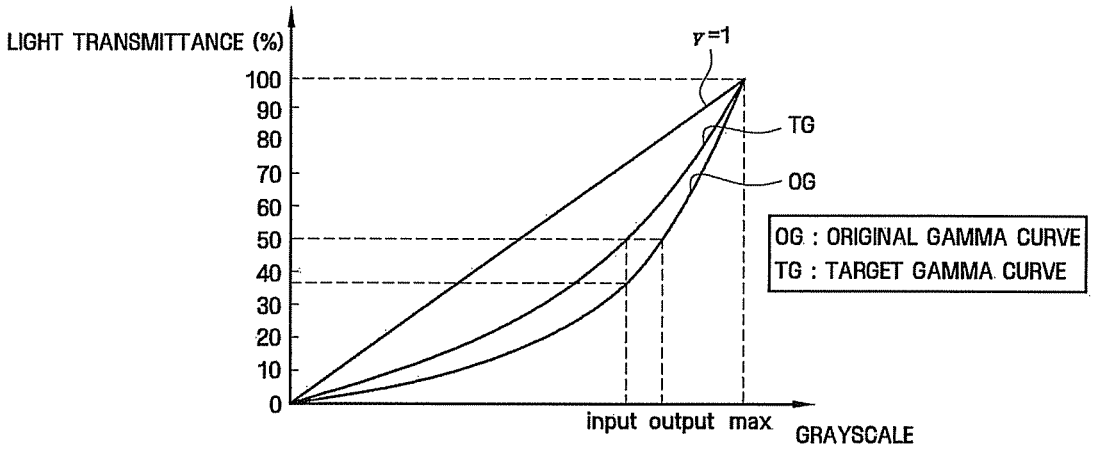
FIG. 4 is a graph of grayscale level versus light transmittance showing an original gamma curve and a target gamma curve according to an exemplary embodiment of the present invention.

The image signal controller 600_1 according to the exemplary embodiment of the present invention shown in FIG. 1 will now be described in further detail with reference to FIGS. 3 and 4. FIG. 3 is a block diagram of the image signal controller 600_1 of the LCD 10 according to the exemplary embodiment of the present invention shown in shown in FIG. 1. FIG. 4 is a graph of grayscale level versus light transmittance showing an original gamma curve and a target gamma curve according to an exemplary embodiment of the present invention.

Referring to FIG. 3, the image signal controller 600_1 includes a control signal generator 610, a gamma converter 620 and a histogram information extractor 630.

The control signal generator 610 receives the external control signals and outputs the data control signal CONT1 and the gate control signal CONT2. In an exemplary embodiment of the present invention, for example, the control signal generator 610 outputs the vertical start signal STV for starting the gate driver 400 (FIG. 1), the gate clock signal CPV for determining when to output the gate-on voltage Von, the output enable signal OE for determining the pulse width of the gate-on voltage Von, the horizontal start signal STH for starting the data driver 500 (FIG. 1), and the output instruction signal TP for controlling the output of the image data voltage.

The gamma converter 620 converts the first image signals R, G and B into the second image signals R', G' and B' and outputs the second image signals R', G' and B' to the data driver 500 (FIG. 1). The first image signals R, G and B have the first gray level, and the second image signals R', G' and B' have the second gray level, as described in greater detail above. The gamma converter 620 converts the first image signals R, G and B into the second image signals R', G' and B' using the LUT 760 which stores the second gray level corresponding to the first gray level based on the target gamma coefficient and the original gamma coefficient, respectively.

The first gray level and the second gray level will now be described in further detail with reference to FIG. 4. Referring to FIG. 4, an original gamma curve OG and a target gamma curve TG are plotted according to coordinates including grayscale versus light transmittance. On an axis which represents the grayscale, e.g., the x-axis, 0 (zero) indicates the lowest gray level, and "max" indicates the highest gray level. The original gamma curve OG represents a relationship between each gray level and light transmittance based on the original gamma coefficient. The target gamma curve TG represents a relationship between each gray level and light transmittance based on the target gamma coefficient. A straight line shown in FIG. 4 represents a relationship between each gray level and light transmittance when a gamma coefficient $\gamma$ is 1 (one). In an exemplary embodiment of the present invention, the original gamma coefficient is approximately 2.2, which is known as an ideal gamma coefficient, and the target gamma coefficient in a range from approximately 1.0 to approximately 2.2.

When a specified input light transmittance corresponding to a specified gray level ("input") exists on the target gamma curve TG, a corresponding gray level ("output") corresponding to a corresponding light transmittance which is equal to the specified light transmittance, can be found from the original gamma curve OG. In an exemplary embodiment of the present invention, the specified gray level (input in FIG. 4) corresponds to the first gray level, and the gray level (output in FIG. 4) on the original gamma curve OG corresponds to the second gray level. At each gray level, light transmittance on the target gamma curve TG is greater than a corresponding light transmittance on the original gamma curve OG, as can be seen in FIG. 4.

Therefore, when the gamma converter 620 converts the first image signals R, G and B into the second image signals R', G' and B' and outputs the second image signals R', G' and B', the first image signals R, G and B have the first gray level, and the second image signals R', G' and B' have the second gray level. In addition, the liquid crystal panel 300 displays an image based on the second image signals R', G' and B'. Thus, a light transmittance of an image displayed on the liquid crystal panel 300 is increased in response to the first image signals R, G and B.

Referring again to FIG. 3, the histogram information extractor 630 according to an exemplary embodiment of the present invention receives the first image signals R, G and B, extracts the numbers of pixels #R, #G and #B at each gray level, and outputs the numbers of pixels #R, #G and #B to the histogram information repository 770 (FIG. 1).

Figure 5:
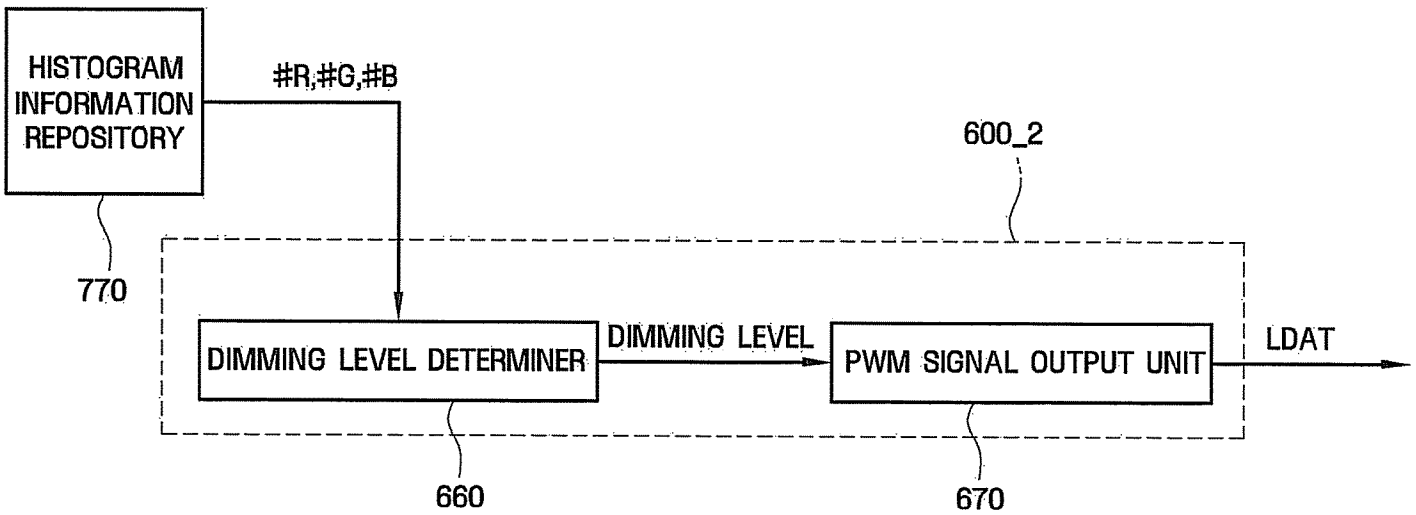
FIG. 5 is a block diagram of an optical data signal controller of the LCD according to the exemplary embodiment of the present invention shown in FIG. 1.

The optical data signal controller 600_2 of FIG. 1 will now be described in further detail with reference to FIG. 5. FIG. 5 is a block diagram of the optical data signal controller 600_2 of the LCD 10 according to the exemplary embodiment of the present invention shown in FIG. 1.

Referring to FIG. 5, the optical data signal controller 600_2 according to an exemplary embodiment includes a dimming level determiner 660 and a pulse width modulation ("PWM") signal output unit 670.

The dimming level determiner 660 receives the numbers of pixels #R, #G and #B at each gray level from the histogram information repository 770, and determines a dimming level which minimizes the amount of luminance distortion of the image displayed on the liquid crystal panel 300. As described in further detail above, the luminance of light provided by the light-emitting unit LB (FIG. 1) is adjusted to minimize the amount of luminance distortion. Specifically, the dimming level according to an exemplary embodiment is defined as a ratio of adjusted luminance of the light to a maximum luminance which can be provided by the light-emitting unit LB.

The amount of luminance distortion will be now be described in further detail. In an exemplary embodiment of the present invention, the amount of luminance distortion is determined by comparing an ideal luminance at each gray level to a real luminance at each gray level of the image displayed on the liquid crystal panel 300. Specifically, the amount of luminance distortion is determined based on Equation (1).

$$\sum_i N_i^2 (L_{ideal(i)} - L_{real(i)})^2, \qquad \text{Equation (1)}$$

where $L_{ideal(i)}$ is ideal luminance at each gray level, e.g., a theoretical luminance when a gamma coefficient is 2.2, e.g., the ideal gamma coefficient, and $L_{real(i)}$ is real luminance, which is reproduced on the liquid crystal panel 300 at each gray level. Ni is the number of pixels at each gray level.

Thus, to obtain the amount of luminance distortion, the difference between the ideal luminance and the real luminance at each gray level is multiplied by the number of pixels at each gray level. Then, the resultant values are squared and then summed. Put another way, the amount of luminance distortion is equal to a sum of squared products of a number of pixels PX at each gray level of the image and a difference between a real luminance $L_{real(i)}$ and an ideal luminance $L_{ideal(i)}$ at each gray level of the image displayed on the liquid crystal panel 300 in one frame.

In an exemplary embodiment of the present invention, the real luminance Lreal(i) is determined by Equation (2).

$$L_{real(i)} = BL \times (T_{red(i)} + T_{green(i)} + T_{blue(i)}), \qquad \text{Equation (2)}$$

where $T_{red(i)}$, $T_{green(i)}$ and $T_{blue(i)}$ are light transmittances of subpixels, e.g., the red, green and blue subpixels, respectively, included in each pixel PX (FIG. 1) at each gray level, and BL is the dimming level of the light-emitting unit LB.

Thus, the real luminance $L_{real(i)}$ reproduced on the liquid crystal panel 300 is obtained by multiplying the dimming level by the sum of respective light transmittances of subpixels. Put another way, the real luminance $L_{real(i)}$ at each gray level of the image is equal to a sum of light transmittances $T_{red(i)}$, $T_{green(i)}$ and $T_{blue(i)}$ of each of the red, green and the blue subpixels, respectively, multiplied by a ratio of the adjusted luminance of the light to the maximum luminance of the light which can be provided by the light-emitting unit LB (e.g., the dimming level).

Minimizing the amount of luminance distortion by adjusting the dimming level will be described in further detail below with reference to FIGS. 7 through 10.

Referring again to FIG. 5, the PWM signal output unit 670 outputs the optical data signal LDAT corresponding to the dimming level provided by the dimming level determiner 660. In an exemplary embodiment, the optical data signal LDAT is a PWM signal. A pulse width of the PWM signal is determined by the dimming level. Specifically, a higher the dimming level corresponds to a higher, e.g., longer, pulse width. Conversely, a lower dimming level corresponds to a lower, e.g., short, pulse width. Further, the pulse width of the optical data signal LDAT corresponds to a duty ratio thereof. Thus, as the pulse width of the optical data signal LDAT is increased, e.g., as the duty ratio of the optical data signal LDAT is increased, a luminance of light provided by the light-emitting unit LB increases.

Figure 6:
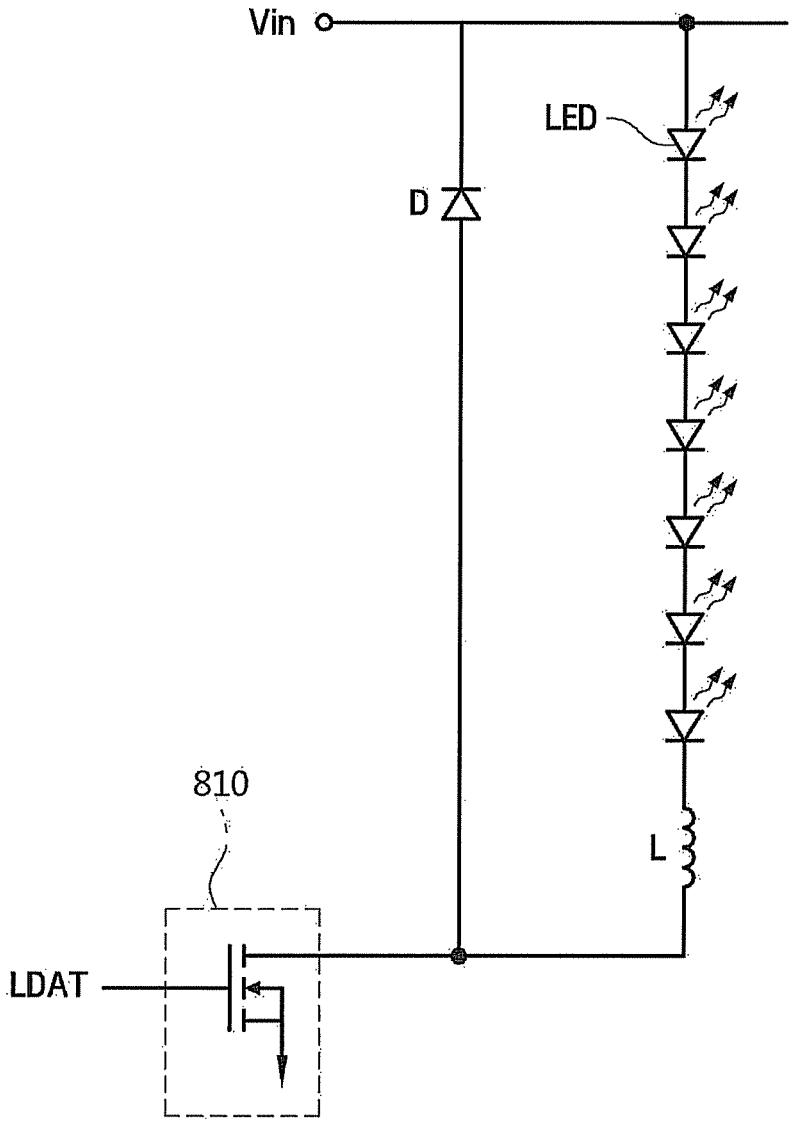
FIG. 6 is a schematic circuit diagram of a backlight driver and a light-emitting unit of the LCD according to the exemplary embodiment of the present invention shown in FIG. 1.

Operation of the backlight driver 800 and the light-emitting unit LB will now be described in further detail with reference to FIG. 6. FIG. 6 is a schematic circuit diagram of the backlight driver 800 and the light-emitting unit LB of the LCD 10 according to the exemplary embodiment of the present invention shown in FIG. 1.

Referring to FIG. 6, the backlight driver 800 includes a switching device 810 and controls the luminance of the light-emitting unit LB based on the optical data signal LDAT.

Specifically, when the optical data signal LDAT is at a high level, the switching device 810 of the backlight driver 800 is turned on, and a power supply voltage Vin is applied to the light-emitting unit LB. Accordingly, electric current flows through the light-emitting unit LB and an inductor L attached in electrical series with the LEDs of the light-emitting unit LB. As a result, the inductor L stores energy generated by the electric current flowing therethrough. When the optical data signal LDAT transitions to a low value, however, the switching device 810 of the backlight driver 800 is turned off, and the light-emitting unit LB, the inductor L, and a diode D thereby form a closed circuit. Accordingly, electric current flows through the closed circuit. Specifically, the energy stored in the inductor L is discharged, thereby reducing an amount of the electric current. Since the duty ratio of the optical data signal LDAT determines a period of time during which the switching device 810 is turned on, the duty ration of the optical data signal LDAT also determines the luminance of the light-emitting unit LB.

Figure 7:
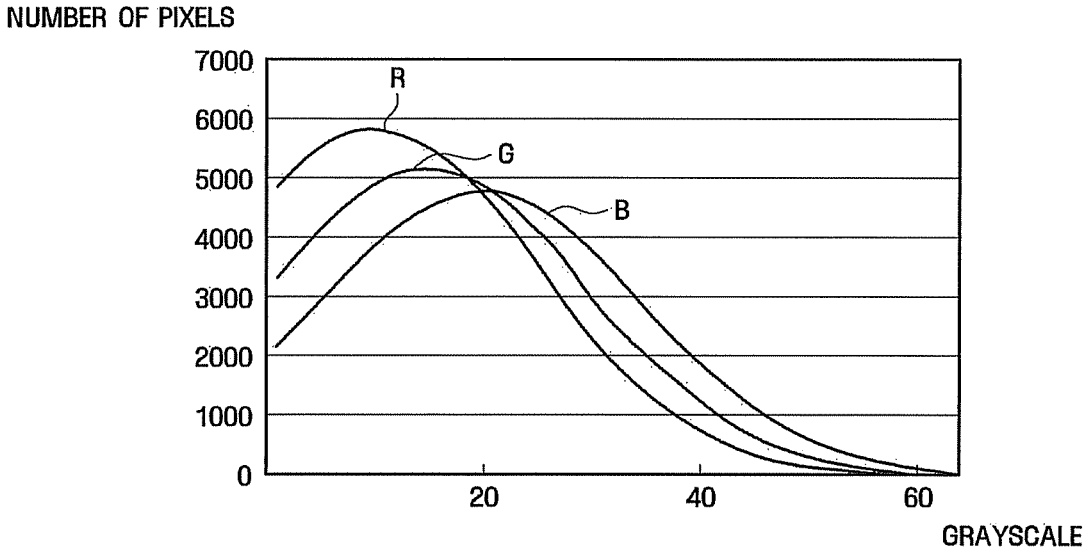
FIG. 7 is a graph of grayscale level versus number of pixels illustrating histogram information of an image displayed on the LCD according to the exemplary embodiment of the present invention FIG. 1.
Figure 8:
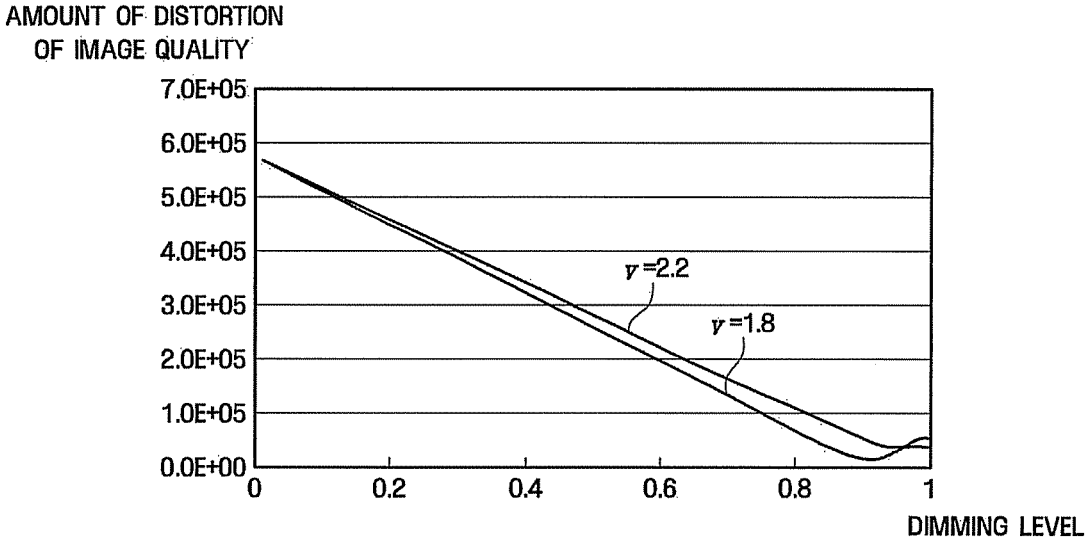
FIG. 8 is a graph of dimming level versus image distortion illustrating luminance distortion of the image which has the histogram information shown in FIG. 7 and which is displayed on the LCD according to the exemplary embodiment of the present invention shown in FIG. 1.
Figure 9:
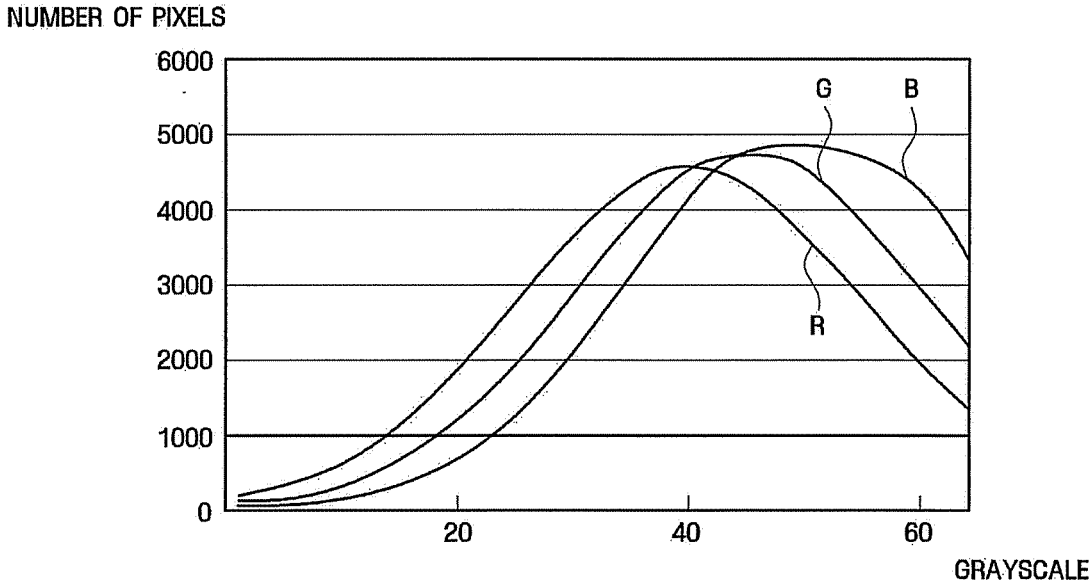
FIG. 9 is a graph of grayscale level versus number of pixels illustrating histogram information of another image displayed on the LCD according to the exemplary embodiment of the present invention shown in FIG. 1.
Figure 10:
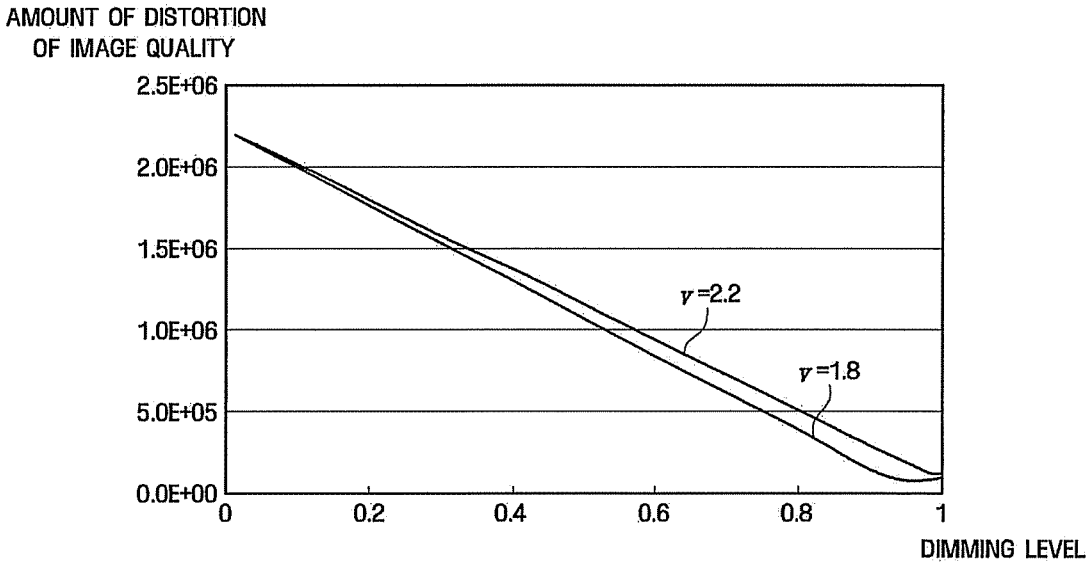
FIG. 10 is a graph of dimming level versus image distortion illustrating luminance distortion of the image which has the histogram information shown in FIG. 9 and which is displayed on the LCD according to the exemplary embodiment of the present invention shown in FIG. 1.

Minimizing the amount of luminance distortion by adjusting the dimming level will now be described in further detail with reference to FIGS. 7 through 10. FIG. 7 is a graph of grayscale level versus number of pixels illustrating histogram information of an image displayed on the LCD 10 according to the exemplary embodiment of the present invention shown in FIG. 1. FIG. 8 is a graph of dimming level versus image distortion illustrating luminance distortion of the image which has the histogram information shown in FIG. 7 and which is displayed on the LCD 10 according to the exemplary embodiment of the present invention shown in FIG. 1. FIG. 9 is a graph of grayscale level versus number of pixels illustrating histogram information of another image displayed on the LCD 10 according to the exemplary embodiment of the present invention shown in FIG. 1. FIG. 10 is a graph of dimming level versus image distortion illustrating luminance distortion of the image which has the histogram information shown in FIG. 9 and which is displayed on the LCD 10 according to the exemplary embodiment of the present invention shown in FIG. 1.

The histogram information illustrated in FIGS. 7 and 9 is based on an assumption, made only for purposes of illustration herein, that the LCD 10 has 64 gray levels, with a lowest gray level thereof being 0 (zero) and a highest gray level thereof being 63. Further, the histogram information indicates numbers of red ("R"), green ("G") and blue ("B") subpixels of a pixel PX at each gray level of the 64 gray levels. Thus, by comparing the histogram shown in FIG. 7 to the histogram shown in FIG. 9, it can be seen that the image associated with FIG. 7 contains more high gray-level pixels than the image associated with FIG. 9. Put another way, the image of FIG. 7 is a dark image having low luminance relative to the image of FIG. 9, which is a bright image having relatively high luminance.

The graphs of FIGS. 8 and 10 illustrate the dimming level versus the amount of a luminance distortion, e.g., an image quality distortion, with respect to the original gamma coefficient and the target gamma coefficient. For purposes of illustration in FIGS. 8 and 10, it is assumed that the original gamma coefficient is approximately 2.2 and that the target gamma coefficient is approximately 1.8, but alternative exemplary embodiments of the present invention are not limited thereto.

Referring to FIG. 8, when the original gamma coefficient is $\gamma=2.2$, the amount of luminance distortion is minimum when the dimming level is approximately 0.98, e.g., when a luminance of the light-emitting unit LB is effectively maximum. In this case, an amount of luminance distortion, and more particularly, a minimum amount of luminance distortion, is approximately 34,000. On the other hand, when the target gamma coefficient $\gamma=1.8$, the amount of luminance distortion is effectively minimum when the dimming level is approximately 0.92. In this instance, the minimum amount of luminance distortion is approximately 13,426.

Therefore, when the target gamma coefficient is used instead of the original gamma coefficient to display the image of FIG. 7, e.g., a dark image having the relatively low luminance, the amount of luminance distortion of the image is substantially reduced in the LCD 10 according to an exemplary embodiment of the present invention. Consequently, a display quality of the LCD 10 is substantially enhanced. In addition, when the dimming level is low, the luminance of the light-emitting unit LB is reduced, which, in turn, reduces power consumption of the light-emitting unit LB. Therefore, when the target gamma coefficient is used instead of the original gamma coefficient, power consumption of the LCD 10 according to an exemplary embodiment is substantially reduced.

Likewise and referring now to FIG. 10, when the original gamma coefficient is $\gamma=2.2$, the amount of luminance distortion is effectively minimum when the dimming level is approximately 1, e.g., when the luminance of the light-emitting unit LB is effectively maximum. Thus, the amount of luminance distortion, e.g., the minimum amount of luminance distortion, is approximately 100,543. On the other hand, when the target gamma coefficient $\gamma=1.8$, the amount of luminance distortion is effectively minimum when the dimming level is approximately 0.97. As a result, the minimum amount of luminance distortion is approximately 68,432.

Therefore, when the target gamma coefficient is used instead of the original gamma coefficient to display the image of FIG. 9, e.g., a bright image having the relatively high luminance, the amount of luminance distortion is substantially reduced. Consequently, the display quality of the LCD 10 according to an exemplary embodiment is substantially enhanced. In addition, when the dimming level is low, the luminance of the light-emitting unit LB is reduced, which, in turn, reduces the power consumption of the light-emitting unit LB. Therefore, when the target gamma coefficient is used instead of the original gamma coefficient, power consumption of the LCD 10 is substantially reduced.

Thus, in the LCD 10 and a method of driving the same according to exemplary embodiments of the present invention described above with reference to FIGS. 1 through 10, first image signals R, G and B having a first gray level with respect to an original gamma coefficient is converted into second image signals R', G' and B' having a second gray level with respect to a target gamma coefficient which is smaller than the original gamma coefficient. Then, the second image signals R', G' and B' are provided to a liquid crystal panel 300, and the liquid crystal panel 300 displays an image in response to the second image signals R', G' and B'. In addition, the amount of luminance distortion is calculated for each frame on which an image is displayed, and a dimming level, which minimizes the amount of luminance distortion, is determined. Accordingly, the luminance of light provided by a light-emitting unit LB is adjusted based on the dimming level. Consequently, as described above, a display quality of the LCD 10 according to an exemplary embodiment is substantially enhanced, and a power consumption thereof is effectively reduced.

Figure 11:
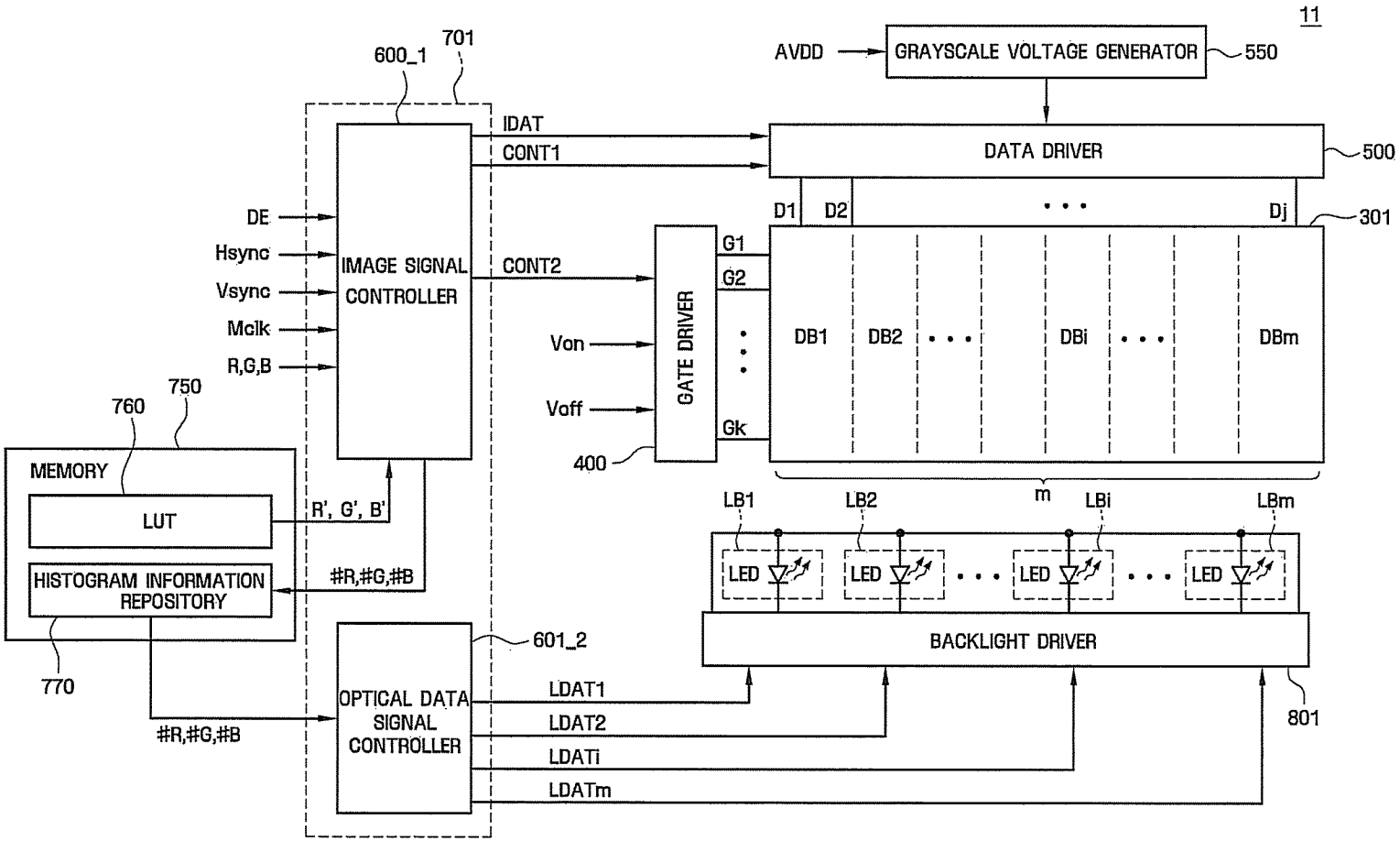
FIG. 11 is a block diagram of an LCD and according to an alternative exemplary embodiment of the present invention.
Figure 12:
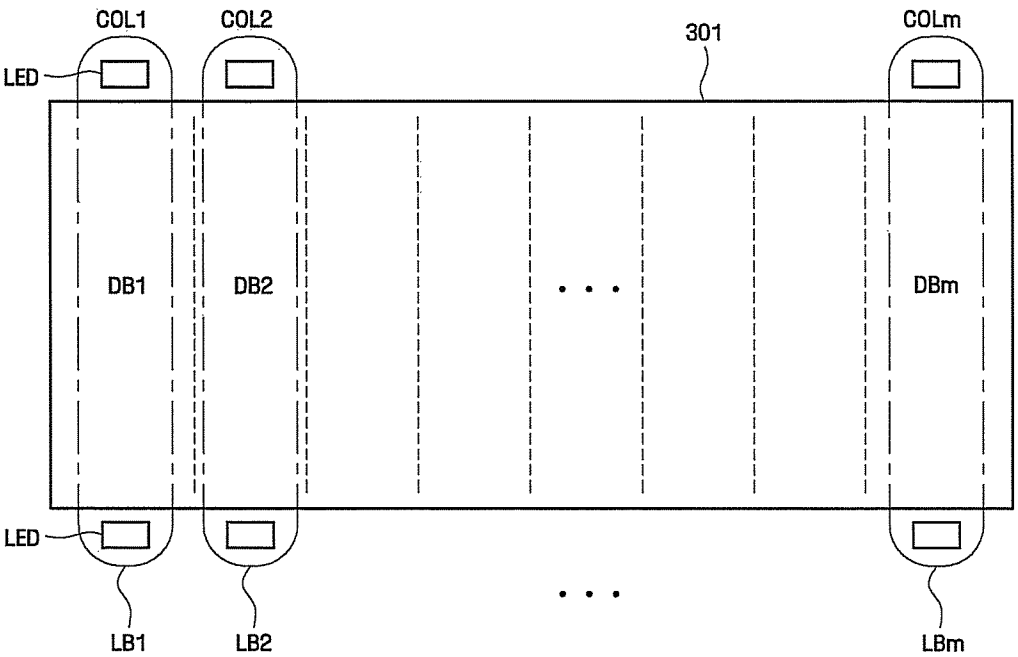
FIG. 12 is a plan view of a plurality of display blocks and a plurality of light-emitting blocks of the LCD according to the exemplary embodiment of the present invention shown in FIG. 11.
Figure 13:
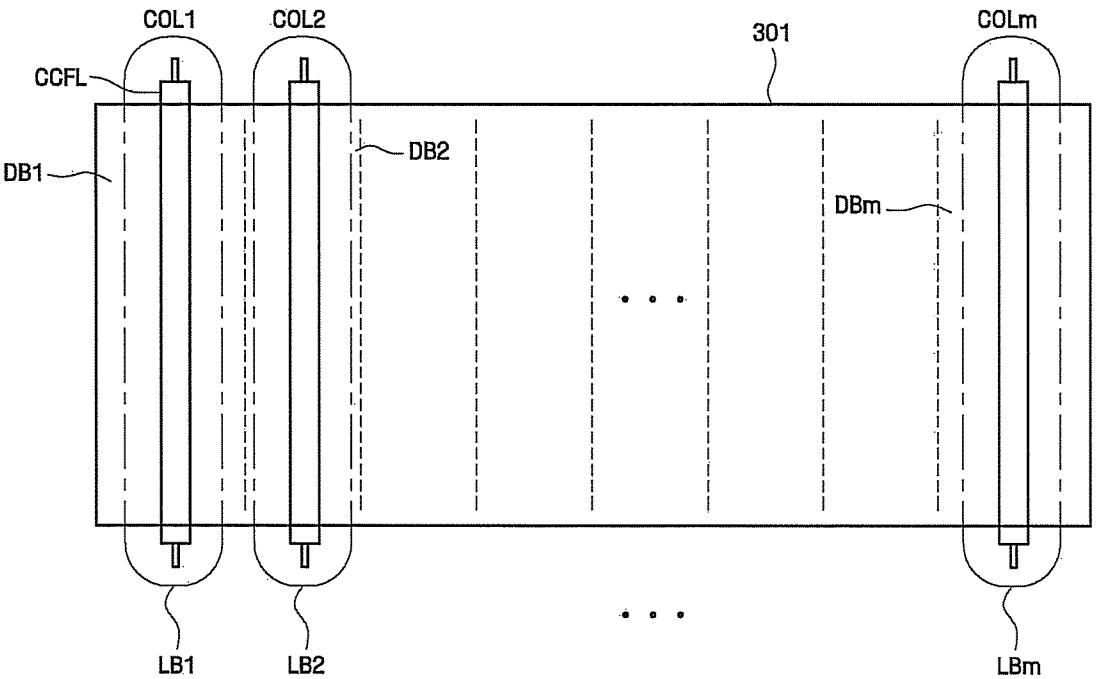
FIG. 13 is a plan view of a plurality of display blocks and a plurality of light-emitting blocks of the LCD according to the exemplary embodiment of the present invention shown in FIG. 11.
Figure 14:
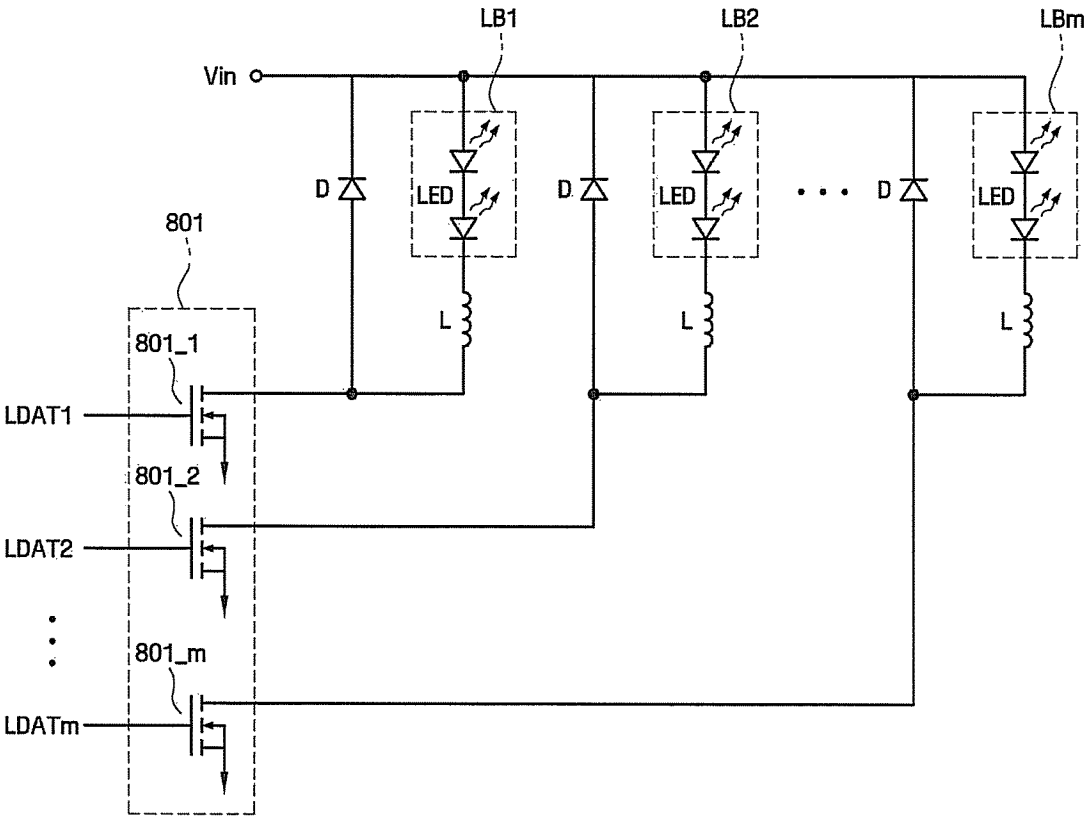
FIG. 14 is a schematic circuit diagram of a backlight driver and light-emitting blocks of the LCD according to the exemplary embodiment of the present invention shown in FIG. 11.

Hereinafter, an LCD and a method of driving the same according to an alternative exemplary embodiment of the present invention will be described in further detail with reference to FIGS. 11 through 14. FIG. 11 is a block diagram of an LCD 11 according to an alternative exemplary embodiment of the present invention. FIG. 12 is a plan view of a plurality of display blocks DB 1 through DBm and a plurality of light-emitting blocks LB1 through LBm of the LCD 11 according to the exemplary embodiment of the present invention shown in FIG. 11. FIG. 13 is a plan view of the plurality of display blocks DB1 through DBm and the plurality of light-emitting blocks LB1 through LBm according to an alternative exemplary embodiment of the present invention. FIG. 14 is a schematic circuit diagram a backlight driver 801 and the plurality of light-emitting blocks LB1 through LBm of the LCD 11 according to the exemplary embodiment of the present invention shown in FIG. 11. The same or like components to those of previously-described exemplary embodiments are indicated by the same reference numerals, and thus any repetitive detailed description will hereinafter be omitted.

Referring to FIG. 11, the LCD 11 includes a liquid crystal panel 301, a signal controller 701, a grayscale voltage generator 550, a gate driver 400, a data driver 500, a memory 750, the backlight driver 801 and light-emitting blocks LB1 through LBm of the plurality of light-emitting blocks LB1 through LBm connected to the backlight driver 801.

The liquid crystal panel 301 includes display blocks DB1 through DBm to display an image thereon. The display blocks DB1 through DBm according to an exemplary embodiment may be arranged in a matrix having one (1) row and m columns, as shown in FIG. 11, but alternative exemplary embodiments are not limited thereto. In an exemplary embodiment, the display blocks DB1 through DBm correspond to columns COL of the light-emitting blocks LB1 through LBm, respectively. For example, an $i^{th}$ display block DBi corresponds to an $i^{th}$ light-emitting block LBi.

The signal controller 701 receives first image signals R, G and B and external control signals for controlling display of the first image signals R, G and B and outputs second image signals R', G' and B', a data control signal CONT1, a gate control signal CONT2, an image data signal IDAT and first through $m^{th}$ optical data signals LDAT1 through LDATm.

Specifically, the signal controller 701 according to an exemplary embodiment converts the first image signals R, G and B having a first gray level based on an original gamma coefficient into the second image signals R', G' and B' having a second gray level based on a target gamma coefficient. In an exemplary embodiment, the target gamma coefficient is less than or equal to the original gamma coefficient, as described in greater detail above. The signal controller 701 according to an exemplary embodiment also provides the first through $m^{th}$ optical data signals LDAT1 through LDATm to the backlight driver 801. In this case, the first through $m^{th}$ optical data signals LDAT1 through LDATm have respective duty ratios which minimize amounts of luminance distortion of images displayed on the display blocks DB1 through DBm, respectively.

The signal controller 701 according to an exemplary embodiment of the present invention includes an image signal controller 600_1 and an optical data signal controller 601_2. The optical data signal controller 601_2 receives numbers of pixels #R, #G and #B at each gray level from a histogram information repository 770, calculates an amount of luminance distortion of an image displayed on each of the display blocks DB 1 through DBm, and provides the first through $m^{th}$ optical data signals LDAT1 through LDATm having duty ratios which minimize the amounts of luminance distortion to the backlight driver 801.

The backlight driver 801 controls a luminance of light provided by the light-emitting blocks LB1 through LBm based on the first through $m^{th}$ optical data signals LDAT1 through LDATm, respectively. The luminances of the light-emitting blocks LB1 through LBm vary according to duty ratios of the first through $m^{th}$ optical data signals LDAT1 through LDATm, respectively. In addition, the duty ratios of the first through $m^{th}$ optical data signals LDAT1 through LDATm are controlled to minimize the amounts of luminance distortion of images displayed on each of the light-emitting blocks LB1 through LBm, respectively. A structure and operation of the backlight driver 801 according to an exemplary embodiment of the present invention will be described in further detail below with reference to FIG. 14.

A light-emitting unit LB according to an exemplary embodiment of the present invention includes the light-emitting blocks LB1 through LBm. Further, the light-emitting blocks LB1 through LBm are disposed under the liquid crystal panel 301 to provide light to the liquid crystal panel 301. In addition, the light-emitting blocks LB1 through LBm may be arranged, for example, in columns COL1 through COLm, as shown in FIGS. 12 and 13, but alternative exemplary embodiments are not limited thereto.

Light sources included in the light-emitting blocks LB1 through LBm may be arranged under a peripheral edge region of the liquid crystal panel 301, as shown in FIG. 12. In this case, the light sources may be point light sources, such as LEDs, arranged under opposite sides of the liquid crystal panel 301. Alternatively, the light sources included in the light-emitting blocks LB1 through LBm, may be arranged directly under the liquid crystal panel 301, as shown in FIG. 13. In this instance, the light sources may be line light sources arranged substantially parallel to each other and disposed under the display blocks DB 1 through DBm. The light sources according to an exemplary embodiment of the present invention may be, for example, cold cathode fluorescent lamps ("CCFLs") or, alternatively, hot fluorescent lamps ("HCFLs"), but alternative exemplary embodiments are not limited thereto.

An operation of the backlight driver 801 and of the light-emitting unit LB, e.g., of the light-emitting blocks LB1 through LBm, shown in FIG. 11 will now be described in further detail with reference to FIG. 14. As described above, FIG. 14 is a schematic circuit diagram of the backlight driver 801 and the light-emitting blocks LB1 through LBm of the LCD 11 according to the exemplary embodiment of the present invention shown in FIG. 11.

Referring to FIG. 14, the backlight driver 801 according to an exemplary embodiment of the present invention includes first through $m^{th}$ switching devices 801_1 through **801_*m* and therewith controls luminances of the light-emitting blocks LB 1 through LBm based on the first through $m^{th}$ optical data signals LDAT1 through LDATm, respectively. The same or like components shown in of FIG. 14 as those in FIG. 6 are designated by the same reference characters as in FIG. 6**, and any repetitive detailed description thereof will hereinafter be omitted.

Thus, the liquid crystal panel 301 included in the LCD 11 according to an exemplary embodiment includes the display blocks DB1 through DBm, and the light-emitting unit LB includes the light-emitting blocks LB1 through LBm. The light-emitting blocks LB1 through LBm correspond to the display blocks DB1 through DBm, respectively, and provide light to the display blocks DB1 through DBm, respectively.

The luminance of light provided to each of the display blocks DB1 through DBm may be adjusted to minimize the amount of luminance distortion of an image displayed on each of the display blocks DB1 through DBm. Therefore, as described above in further detail with respect to FIGS. 1 through 10, a display quality of the LCD 11 is effectively enhanced, and a power consumption thereof is substantially reduced.

Figure 15:
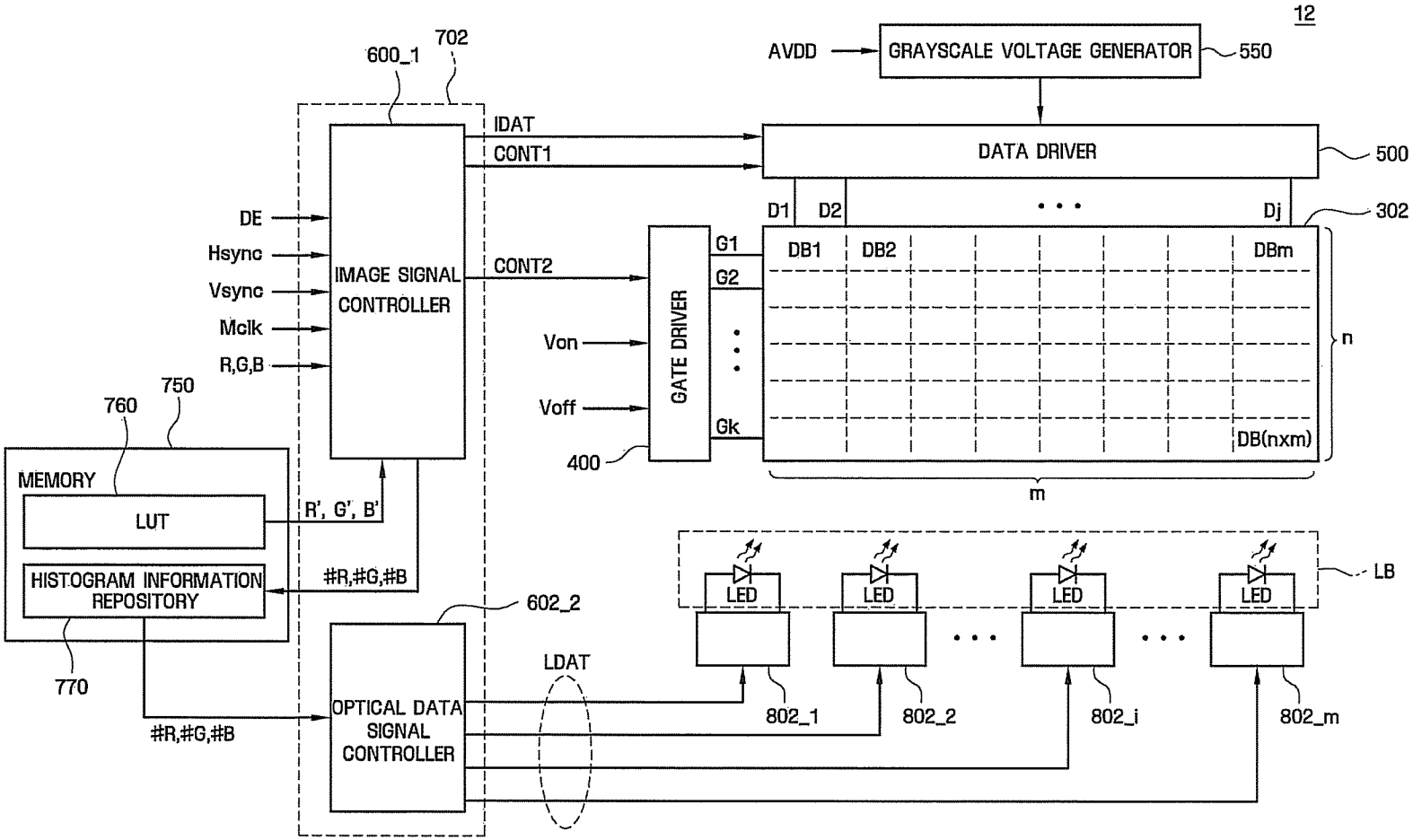
FIG. 15 is a block diagram of an LCD according to another alternative exemplary embodiment of the present invention.
Figure 16:
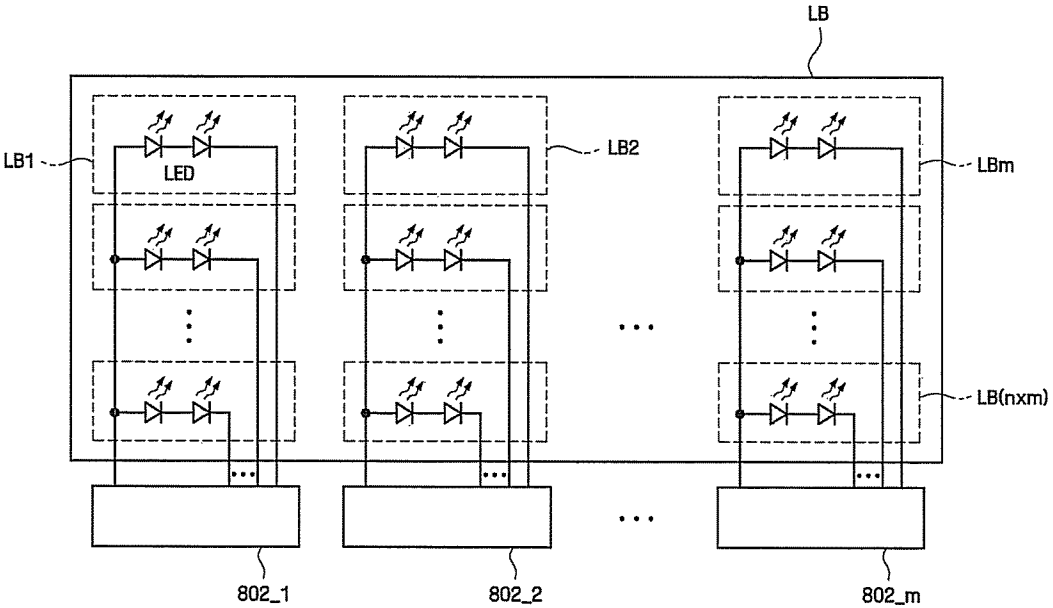
FIG. 16 is a schematic circuit diagram of a plurality of display blocks and a plurality of light-emitting blocks of the LCD according to the exemplary embodiment of the present invention shown in FIG. 15.

Hereinafter, an LCD and a method of driving the same according to another alternative exemplary embodiment of the present invention will be described in further detail with reference to FIGS. 15 and 16. FIG. 15 is a block diagram of an LCD 12 according to another alternative exemplary embodiment of the present invention. FIG. 16 is a schematic circuit diagram of a plurality of display blocks DB1 through DB(nxm) and aplurality of light-emitting blocks LB1 through LB(nxm) of the LCD 12 according to the exemplary embodiment of the present invention shown in FIG. 15. Elements substantially the same as those of previously-described exemplary embodiments are indicated by the same reference numerals, and thus and repetitive description thereof will hereinafter be omitted.

Referring to FIG. 15, the LCD 12 according to an exemplary embodiment includes a liquid crystal panel 302, a signal controller 702, a grayscale voltage generator 550, a gate driver 400, a data driver 500, a memory 750, a plurality of backlight drivers 802_1 through **802_*m*, and a light-emitting unit LB connected to backlight drivers 802_1 through 802_*m* of the plurality of backlight drivers 802_1 through 802_*m*.**

The liquid crystal panel 302 includes display blocks DB1 through DB(nxm) of the plurality of display blocks DB1 through DB(nxm) to display an image thereon. The display blocks DB1 through DB(nxm) are arranged in a matrix having n rows and m columns (where n and m are natural numbers). As a result, the display blocks DB1 through DB(nxm) correspond to the light-emitting blocks LB1 through LB(nxm) of the light-emitting unit LB, respectively.

The signal controller 702 receives first image signals R, G and B and external control signals for controlling display of the first image signals R, G and B and outputs second image signals R', G' and B', a data control signal CONT1, a gate control signal CONT2, an image data signal IDAT and a plurality of optical data signals LDAT.

Specifically, the signal controller 702 converts the first image signals R, G and B having a first gray level based on an original gamma coefficient into the second image signals R', G' and B' having a second gray level based on a target gamma coefficient. In an exemplary embodiment of the present invention, the target gamma coefficient is less than or equal to the original gamma coefficient. The signal controller 702 provides the optical data signals LDAT to the backlight drivers 802_1 through **802_*m*. In this case, optical data signals LDAT of the plurality of optical data signals LDAT have duty ratios which minimize amounts of luminance distortion of images displayed on the display blocks DB1** through DB(nxm).

In an exemplary embodiment of the present invention, the signal controller 702 includes an image signal controller 600_1 and an optical data signal controller 602_2. The optical data signal controller 602_2 receives numbers of pixels #R, #G and #B at each gray level of the image from a histogram information repository 770, calculates amounts of luminance distortion of images displayed on the display blocks DB1 through DB(nxm), and provides the optical data signals LDAT having the duty ratios which minimize the amounts of luminance distortion to the backlight drivers 802_1 through 802_*m,* respectively.

Thus the backlight drivers 802_1 through 802_*m* control luminances of light provided by the light-emitting blocks LB1 through LB(nxm) based on the optical data signals LDAT. The luminances of the light-emitting blocks LB1 through LB(nxm) are controlled by images displayed on the display blocks DB1 through DB(nxm), respectively. The luminances of the light-emitting blocks LB1 through LB(nxm) vary according to the duty ratios of the optical data signals LDAT. In addition, the duty ratios of the optical data signals LDAT are controlled to minimize the amounts of luminance distortion of images displayed on the display blocks DB1 through DB(nxm).

The light-emitting unit LB according to an exemplary embodiment of the present invention includes the light-emitting blocks LB1 through LB(nxm), as shown in FIG. 16 and may further be disposed under the liquid crystal panel 302 (FIG. 15) to provide the light to the liquid crystal panel 302. The light-emitting blocks LB1 through LB(nxm) may be arranged, for example, as shown in FIG. 15, but alternative exemplary embodiments of the present invention are not limited thereto. Specifically, the light-emitting blocks LB1 through LB(nxm) may be arranged in a matrix having n rows and m columns to correspond to the display blocks DB1 through DB(nxm), respectively. Each of the light-emitting blocks LB1 through LB(nxm) may include one or more light-emitting devices, such as one or more LEDs, for example.

The liquid crystal panel 302 included in the LCD 12 according to an exemplary embodiment includes the display blocks DB1 through DB(nxm) and the light-emitting unit LB includes the light-emitting blocks LB1 through LB(nxm) corresponding thereto. Specifically, the light-emitting blocks LB1 through LB(nxm) correspond to the display blocks DB1 through DB(nxm), respectively, and thereby provide light to the display blocks DB1 through DB(nxm), respectively.

A luminance of the light provided to each of the display blocks DB1 through DB(nxm) is controlled to minimize an amount of luminance distortion of portions of an image which are displayed on each of the display blocks DB1 through DB(nxm) top display the image on the LCD 12 according to an exemplary embodiment of the present invention.

Therefore, according to exemplary embodiments of the present invention as described herein, a display quality of an LCD is substantially enhanced, and power consumption thereof is effectively reduced.

The present invention should not be construed as being limited to the exemplary embodiments set forth herein. Rather, these exemplary embodiments are provided so that this disclosure will be thorough and complete and will fully convey the concept of the present invention to those skilled in the art. The exemplary embodiments described herein are to be considered in a descriptive sense only and not for purposes of limitation.

While the present invention has been particularly shown and described with reference to exemplary embodiments thereof, it will be understood by those of ordinary skill in the art that various changes in form and detail may be made therein without departing from the spirit or scope of the present invention as defined by the following claims.

What is claimed is:

1. A liquid crystal display comprising:

a signal controller which converts a first image signal having a first gray level based on an original gamma coefficient into a second image signal having a second gray level based on a target gamma coefficient;

a liquid crystal panel which displays an image based on the second image signal; and a light-emitting unit which provides light to pixels of the liquid crystal panel, wherein the target gamma coefficient is less than the original gamma coefficient, and a luminance of the light provided by the light-emitting unit is adjusted to minimize an amount of luminance distortion of real luminance of the displayed image from ideal luminance at the original gamma coefficient, wherein the amount of luminance distortion is equal to a sum of squared products of a number of the pixels at each gray level of the image and a difference between a real luminance and an ideal luminance at each gray level of the image, wherein each of the pixels is divided into a red subpixel, a green subpixel and a blue subpixel, and wherein the real luminance at each gray level of the image is equal to a sum of light transmittances of each of the red subpixel, the green subpixel and the blue subpixel multiplied by a ratio of an adjusted luminance of the light to a maximum luminance of the light which can be provided by the light-emitting unit.

2. The liquid crystal display of claim 1, wherein a light transmittance of the first gray level is substantially the same as the light transmittance of the second gray level.

3. The liquid crystal display of claim 1, wherein an original gamma curve defines a relationship between gray levels and corresponding light transmittances based on the original gamma coefficient, a target gamma curve defines a relationship between gray levels and corresponding light transmittances based on the target gamma coefficient, and the second gray level is a gray level on the original gamma curve at which a corresponding light transmittance thereof is equal to a light transmittance corresponding to the first gray level on the target gamma curve.

4. The liquid crystal display of claim 3, wherein the first image signal is converted into the second image signal by using a lookup table which stores the gray level on the original gamma curve at which the corresponding light transmittance thereof is equal to the light transmittance corresponding to the first gray level on the target gamma curve.

5. The liquid crystal display of claim 1, wherein the signal controller comprises:

an image signal controller which extracts the number of the pixels at each gray level in the image; and a memory which stores the number of pixels at each gray level in the image extracted by the signal controller.

6. The liquid crystal display of claim 5, wherein the signal controller further comprises an optical data signal controller which calculates the amount of luminance distortion based on the number of the pixels at each gray level stored the memory.

7. The liquid crystal display of claim 5, wherein
the memory comprises a lookup table, and
the memory stores the ideal luminance at each gray level of the image in the lookup table.

8. The liquid crystal display of claim 1, further comprising a backlight driver which adjusts the luminance of the light provided by the light-emitting unit, wherein
the signal controller calculates a dimming level which minimizes the amount of luminance distortion of the image,
the signal controller provides an optical data signal having a duty ratio based on the dimming level to the backlight driver, and
the dimming level is a ratio of an adjusted luminance of the light to a maximum luminance of the light which can be provided by the light-emitting unit.

9. The liquid crystal display of claim 1, wherein
the original gamma coefficient is 2.2, and
the target gamma coefficient is between 1.0 and 2.2.

10. The liquid crystal display of claim 1, wherein the luminance of the light is adjusted for each frame in which the image is displayed.

11. The liquid crystal display of claim 1, wherein
the liquid crystal panel comprises a plurality of display blocks,
the light-emitting unit comprises a plurality of light-emitting blocks which provides the light to the liquid crystal panel,
light-emitting blocks of the plurality of light-emitting blocks correspond to display blocks of the plurality of display blocks, and
a luminance of light provided by each of the light-emitting blocks is adjusted to minimize an amount of luminance distortion of a portion of the image displayed on each of the corresponding display blocks.

12. The liquid crystal display of claim 11, wherein the display blocks and the light-emitting blocks are arranged in a matrix comprising one or more rows and one or more columns.

13. A method of driving a liquid crystal display having a liquid crystal panel which comprises pixels and displays an image and a light-emitting unit which provides light to the liquid crystal panel, the method comprising:
converting a first image signal having a first gray level based on an original gamma coefficient into a second image signal having a second gray level based on a target gamma coefficient less than the original gamma coefficient;
providing the second image signal to the liquid crystal panel; and
adjusting a luminance of the light provided by the light-emitting unit to minimize an amount of luminance distortion of real luminance of the displayed image from ideal luminance at the original gamma coefficient,
wherein the amount of luminance distortion is equal to a sum of squared products of a number of the pixels at each gray level of the image and a difference between a real luminance and an ideal luminance at each gray level of the image, and
wherein the adjusting of the luminance of the light comprises:
calculating a dimming level which minimizes the amount of luminance distortion of the image;
calculating a duty ratio based on the dimming level; and
providing light having a luminance which corresponds to the calculated duty ratio with the light-emitting unit, wherein each of the pixels is divided into a red subpixel, a green subpixel and a blue subpixel, and
the real luminance at each gray level of the image is equal to a sum of light transmittances of each of the red subpixel, the green subpixel and the blue subpixel multiplied by a ratio of an adjusted luminance of the light to a maximum luminance of the light which can be provided by the light-emitting unit.

14. The method of claim 13, wherein
a light transmittance of the first gray level is substantially the same as the light transmittance of the second gray level.

15. The method of claim 13, wherein the converting of the first image signal into the second image signal comprises using a lookup table which stores the second gray level.

16. The method of claim 13, wherein
the liquid crystal panel comprises pixels, and
the adjusting of the luminance of the light comprises:
extracting the number of the pixels at each gray level in the image; and
storing the number of the pixels at each gray level in a memory.

17. The method of claim 16, wherein the adjusting of the luminance of the light further comprises reading the number of pixels at each gray level and calculating the amount of luminance distortion.

18. The method of claim 13, wherein
the liquid crystal panel comprises a plurality of display blocks,
the light-emitting unit comprises a plurality of light-emitting blocks which provides the light to the liquid crystal panel,
light-emitting blocks of the plurality of light-emitting blocks correspond to display blocks of the plurality of display blocks, and
the adjusting of the luminance of the light comprises adjusting a luminance of light provided by each of the light-emitting blocks to minimize an amount of luminance distortion of a portion of the image displayed on each of the corresponding display blocks.

* * * * *